United States Patent [19]

Sheppard

[11] Patent Number: 4,552,340

[45] Date of Patent: Nov. 12, 1985

[54] PORTABLE WINCH

[75] Inventor: Joseph R. Sheppard, Oregon City, Oreg.

[73] Assignee: True Dimension Inc., Oregon City, Oreg.

[21] Appl. No.: 537,094

[22] Filed: Sep. 29, 1983

[51] Int. Cl.[4] ..... B66D 3/18

[52] U.S. Cl. ..... 254/358; 254/346; 254/378

[58] Field of Search ..... 254/358, 346, 299, 378

[56] References Cited

U.S. PATENT DOCUMENTS

| | | | |
|---|---|---|---|
| 1,768,278 | 6/1930 | Whitaker | 254/358 |
| 1,931,655 | 10/1933 | Haseltine | 254/346 X |
| 2,080,804 | 5/1937 | Brantly | 254/378 X |
| 2,309,285 | 1/1943 | Walton | 254/358 X |
| 2,869,822 | 1/1959 | Shurtliff | 254/358 |
| 3,291,452 | 12/1966 | Rau et al. | 254/358 |
| 3,322,398 | 5/1967 | Smith | 254/335 X |
| 3,938,781 | 2/1976 | Craven et al. | 254/380 X |
| 4,145,028 | 3/1979 | Kelley et al. | 242/54 R X |
| 4,162,059 | 7/1979 | Fletchall | 254/358 |
| 4,444,375 | 4/1984 | Horn | 254/356 X |

FOREIGN PATENT DOCUMENTS

| | | | |
|---|---|---|---|
| 474214 | 2/1915 | France | 254/346 |

*Primary Examiner*—Stuart S. Levy
*Assistant Examiner*—Joseph J. Hail, III
*Attorney, Agent, or Firm*—Kolisch, Hartwell & Dickinson

[57] ABSTRACT

A light-weight portable winch which incorporates a low-horsepower motor, a speed-reducing transmission which is supported by outrigger bearings, a cable take-up drum which is disengagable from the speed-reducing transmission, and a positive lock brake which acts on the drum and which is operable, independently of the winch motor, to prevent rotation of the drum.

6 Claims, 5 Drawing Figures

PORTABLE WINCH

BACKGROUND AND SUMMARY OF THE INVENTION

The instant invention pertains to a portable winch. Specifically, the winch of the instant invention is a lightweight, portable unit which incorporates a low-horsepower motor, a speed-reducing transmission which is supported by outrigger bearings, a cable take-up drum which is disengagable from the speed-reducing transmission, and a positive lock brake which acts on the drum and which is operable, independently of the winch motor, to prevent rotation of the drum.

Known portable winch units are of the type which may be manually positioned in a particular location, or of the type which is normally mounted on light truck chassis. Neither type of winch is truly portable. Known manually positionable winches generally weigh 80–100 lbs. Truck mounted winches are portable only to locations where the truck may be driven. Known portable winches utilize rather expensive, heavy, speed-reducing transmissions, which transform high-speed, low-power force, from a motor, to low-speed, high-power force which is transmitted to a takeup drum or spool.

Additionally, known winches utilize complex components such as cable fairlead or even-wind devices. These devices may restrict the speed at which line may be payed out from the winch drum.

A primary object of the instant invention is to provide a truly portable, light-weight winch, which is economical to manufacture and which is composed of relatively inexpensive components.

Another object of the instant invention is to provide a winch with a light-weight winch speed reducing transmission which is supported by side-mount, outrigger bearings, which absorb heavy load forces from a winch load and prevent the internal bearings of the transmission from carrying heavy load forces.

A further object of the instant invention is to provide a portable winch which includes a positive lock brake, which is operable independently of the winch motor.

Yet another object of the instant invention is to provide a portable winch which allows cable to be payed out from the takeup spool at a high rate of speed.

An additional object of the instant invention is to provide a portable winch which has a drum which is disengageable from the motor-gear reduction unit to facilitate rapid cable payout.

The winch of the instant invention includes an open frame on which the individual components are mounted. The frame further includes an elongate base, with two sides which extend along at least part of the base. A small, low horsepower motor (generally one or two horsepower) is mounted at one end of the frame base. The motor is connected to a speed-reducing transmission which is mounted on the frame and which is additionally supported by side mount outrigger bearings. The output of the speed-reducing transmission is connected to a gear which is engageable with a cable drum. A positive lock brake is associated with one side of the drum and acts to restrain movement of the drum against a force exerted on a cable attached to the drum. The engagement between the gear associated with the drum and the drum is such that the drum may be disconnected from a driving force provided by the motor. Cable may be payed out from the drum, the pay out rate being controlled by the positive lock brake. The winch is secured to a stationary anchor by cables which are attached adjacent the motor at one end of the frame. In operation, the winch itself will generally be airborne, lifted between the cables attached to the stationary anchor and a moving cable, which is attached to the spool. A handle mounted on the frame adjacent the drum is used to rock the winch from side to side, providing even winding of cable on the drum.

These and other objects and advantages of the instant invention will be more fully appreciated as the description which now follows is read in conjunction with the drawings.

DETAILED DESCRIPTION OF THE INVENTION

Figures 1, 4:
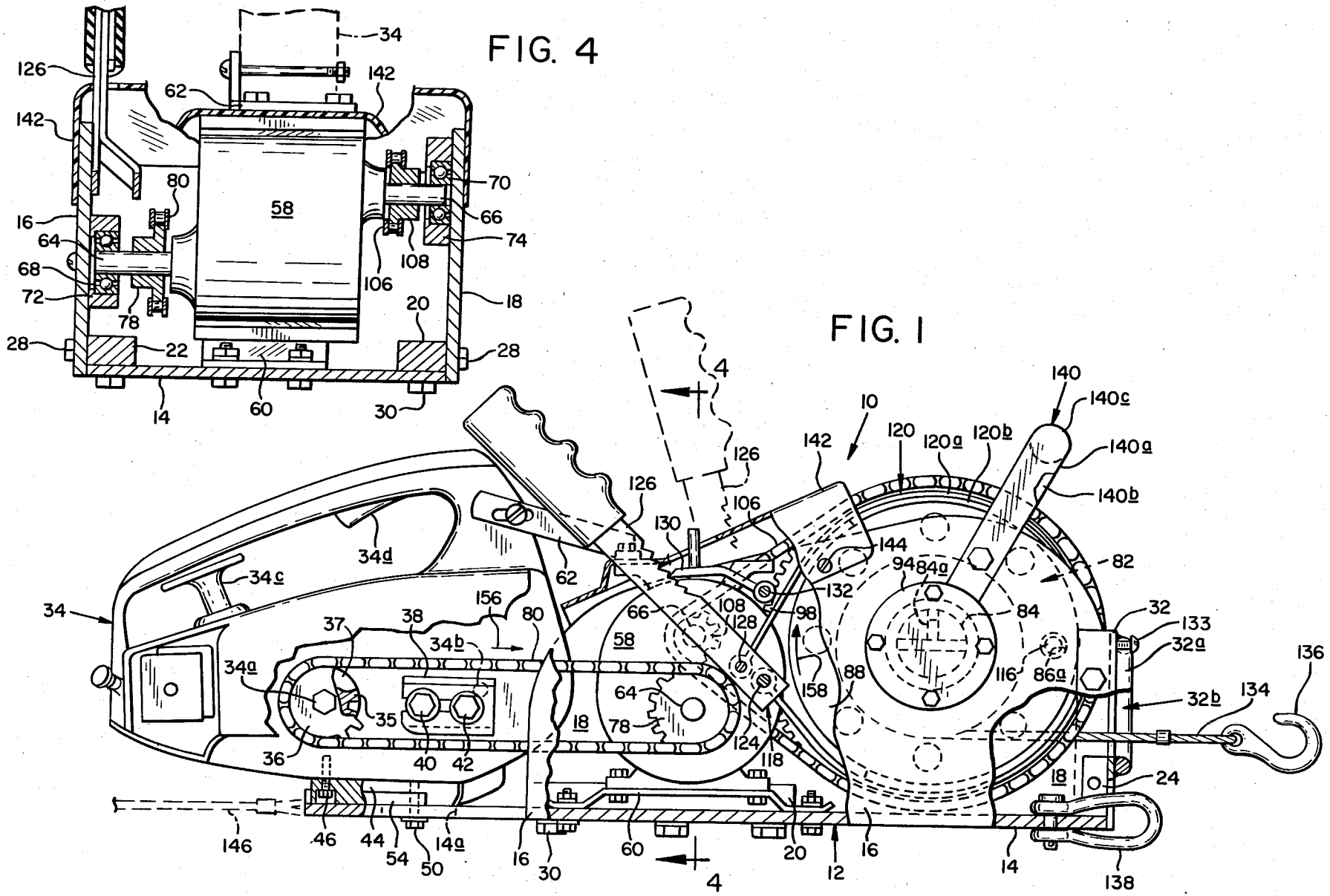
FIG. 1 is a side elevation of a portable winch constructed according to the invention, with portions broken away to show detail.
FIG. 4 is a cross section of the winch, taken generally along the line 4—4 in FIG. 1.

Turning now to the drawings, and with particular attention to FIG. 1, a portable winch constructed according to the instant invention is shown generally at 10. The winch includes a frame 12 which has an elongate base 14, and a pair of opposed, spaced-apart sides, shown at 16 and 18. Frame 12 may be formed by casting aluminum alloy, or, may be formed by fastening individual base and side elements together, as has been done in the embodiment being presently described. With this type of frame construction, the sides are secured to the base by braces, such as those shown in FIG. 2 at 20, 22, 24 and 26, which are drilled and tapped to permit securing to the base and sides by machine bolts, such as those depicted at 28 and 30 (FIG. 1). A cable guide or fairlead, 32 is fastened to the sides of the frames. Guide 32 provides additional stability to sides 16 and 18, and includes a round-edged reinforcement ring **32*a* which surrounds a cable guide opening 32*b*** through which a cable passes.

The winch is powered by a gasoline-powered engine, shown generally at 34. Engine 34 is of the type used to power small chain saws and is a chain saw motor unit. In the preferred embodiment, a two HP Homelite engine is depicted as power source. Engine 34 is mounted adjacent one end of base 14. Prior to mounting the motor unit on the winch frame, the cutting chain and chain bar which normally completes the usual chain saw are removed from the motor unit, and a sprocket 36 is positioned on an engine output shaft **34*a*. It should be noted that the standard driving gear 35 and clutch 37, which are utilized to drive a cutting chain remain in place to facilitate rapid conversion of engine 34** to a chain saw power source.

Engine 34 includes an automatic chain oiler port **34*b*. An oil diverter plate 38 is attached, such that it substantially covers port 34*b*, by cutting chain bar bolts 40, 42**.

Figure 2:
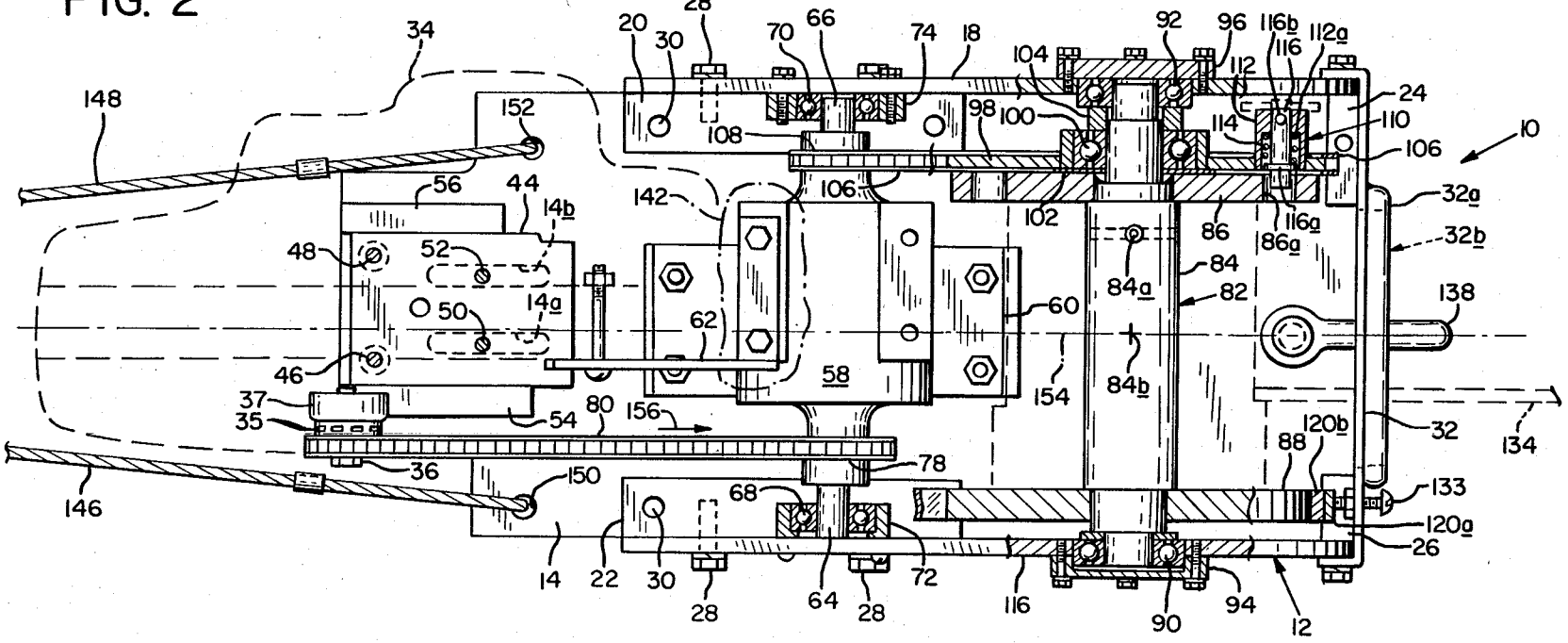
FIG. 2 is a top plan view of the winch of the instant invention, with portions broken away to show detail.

Referring now to FIGS. 1 and 2, engine 34 is secured to frame 12 by means of a motor mount plate 44. Plate 44 is initially secured to the base of the housing of motor unit 34 by bolts 46, 48. Plate 44 is then affixed to base 14 by means of bolts 50, 52 which secure plate 44 to base 14, and which may be adjusted along a portion of base 14 within the elongate slots 14*a*, 14*b*. Tortional stabililty is provided by means of motor mount side plates 54, 56, which preclude tortionally induced movement of plate 44 on base 14. Plate 44 as depicted is specifically constructed to accommodate the Homelite motor. The form of plate 44 may be modified to accommodate other engines or motors which may be used to power the winch.

Adjacent engine 34 is a speed-reducing transmission 58. Transmission 58 is bolted to a transmission mounting plate 60, which is in turn bolted to the winch frame. Additionally, a brace 62 is bolted to the top of transmission 58 and also to engine 34. Brace 62 provides additional stability for engine 34.

Turning now to FIG. 4, transmission 58 includes an input shaft 64 and an output shaft 66. Transmission 58 is a gear-reducing unit. Specifically, in the preferred embodiment, transmission 58 is a Dayton In-Line Speed Reducer Model #2Z820A which has a 53:1 gear ratio, and is designed to operate with a 1/10 HP maximum input. An important feature of the invention is the use of auxilliary, or outrigger bearings to support the input and output shafts of the transmission. A pair of outrigger bearings 68, 70 are retained in bearing mounts 72, 74, which are attached to sides 16, 18, and provide a journaling mechanism for the input shaft and output shaft, respectively. Bearings 68 and 70, also referred to herein as third and fourth bearings, respectively, are sealed units, and are arranged on their respective shafts so as to remove a majority of the forces which would normally act on a set of needle bearings in the transmission. The use of the outrigger bearings enables the winch of the instant invention to be manufactured with a relatively inexpensive, light-weight gear-reduction unit which is thus bolstered to perform beyond its intended limitations.

An input shaft sprocket 78 is fixed on shaft 64, and is driven by a drive chain or first power-transmitting means 80, which is a roller chain, connected about sprocket 36. Sprockets 36 and 78 in the preferred embodiment are both 18-tooth sprocket.

A drum assembly 82 is mounted transversely of frame 12 at the end of frame 12 opposite motor 34. Drum assembly 82 includes a drum for collecting cable windings which is formed of a drum shaft 84 and two end flanges 86, 88, which are joined to shaft 84, as by welding. As can be seen in FIG. 2, shaft 84 extends between one side (side 16) of frame 12 and the other side (side 18) of frame 12 and is journaled in a first bearing 90 and a second bearing 92 which are retained in bearing mounts 94, 96, which are secured to frame sides 16, 18, respectively. The bearings and mounts provide a means for rotatably mounting drum shaft 84 on frame 12. Shaft 84 contains a T-shaped bore 84*a*, which receives an end of a cable, which is carried on the drum. The cable is secured in place by a set screw located in the "upright" portion of the T.

A drive sprocket 98 is mounted on shaft 84 by means of drive-sprocket bearing 100. A pair of spacers 102, 104 provide proper lateral separation of sprocket 98 from flange 86 and bearing 92. Sprocket 98 is driven by a roller chain 106, which is in turn driven by an output sprocket 108 mounted on output shaft 66. Chain 106 and sprocket 98 comprise what is referred to herein as second power-transmitting means. In the preferred embodiment, the output sprocket contains thirteen teeth and the drive sprocket contains 54 teeth. The overall input to output ratio of the winch, in the preferred embodiment, beginning with sprocket 36 and ending with sprocket 108 is a ratio of 222:1.

Figure 3:
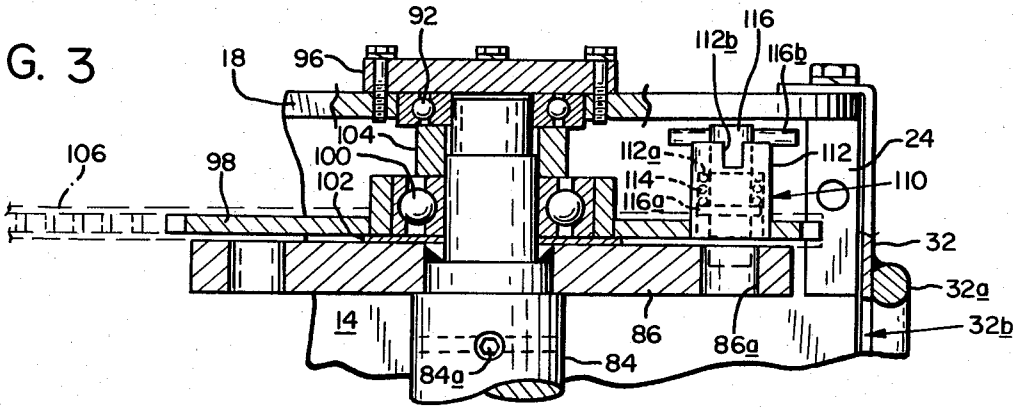
FIG. 3 is a greatly enlarged view of a portion of the winch showing a drive pin assembly.

Sprocket 108 is selectively drivingly engageable with the drum assembly by means of an interlocking device, shown generally at 110 in FIG. 3. Device 110 is also referred to herein as a means for selectively establishing a driving connection, or selection means. Device 110 includes a cylindrical portion 112 which is secured to sprocket 108, as by welding. Portion 112 includes a step, shown at 112*a* which acts as a rest for a spring 114. A spring-biased pin 116 with a flange 116*a* is received within portion 112. A handle 116*b* restrains pin 116 against the action of spring 114, which coacts between step 112*a* and flange 116*a*. Pin 116 may be rotated to allow handle 116*b* to drop into a slot 112*b* in cylindrical portion 112, thereby allowing an end of pin 116 (as shown in phantom lines in FIG. 3 and solid lines in FIG. 2), to extend into one of eight bores, such as that illustrated at 86*a* which are formed in one drum flange 86. Portion 112 includes an indent at 90 degrees to slot 112*b* to hold handle 116*b* in place in a retracted position. Pin 116 is thus retractable to disestablish a driving condition between drive sprocket 98 and the drum assembly, and extensible to establish a driving connection therebetween. The importance of this feature will be more fully apparent once the remaining components of the winch are described.

A brake operates on the other drum flange 88 adjacent the other end of shaft 84. The brake includes a brake band 120 which encircles flange 88 about its periphery. Band 120 includes a substantially circular metal portion 120*a* and a brake band lining 120*b*, which frictionally acts on the edge of flange 88. Band 120 is attached to one side of frame 12 by means of a fastener 124. Fastener 124 acts as a securing and pivot point for a brake lever 126. The other end of band 120 is secured to lever 126 by means of a pin 128. Lever 126 may be moved between a braking position, shown in solid lines in FIG. 1, and a released position, shown by phantom lines in FIG. 1. When lever 126 is in its released position, band 120 is slack about the periphery of flange 88, and the drum assembly may freely rotate. When lever 126 is moved to its braking position, band 120 is tightened, with lining 120*b* coming in tight, frictional contact with the periphery of flange 88, thereby preventing rotation of the drum assembly. Lever 126 includes several rachet-like teeth, which may be acted upon by a brake pawl, 130, which is moveable about a pin 132, and maybe positioned to lock lever 126 in a given position. A brake adjusting screw 133 is located on guide 32 and may be adjusted to provide "drag" on flange 88.

A length of cable, 134 is secured through bore 84*a* and wound on the drum. In the preferred embodiment, 5/32 inch aircraft cable is provided. The particular cable used has a breaking test weight of 3,150 lbs. A cable length in excess of 200 feet of this size cable may be wound on the drum. Cable 134 terminates in a hook 136. Additionally, a clevis 138 is provided at one end of base 14.

A winch handle 140 includes a pair of handle uprights 140*a*, 140*b*, and a cross piece 140*c*, and is mounted on the frame sides.

Figure 5:
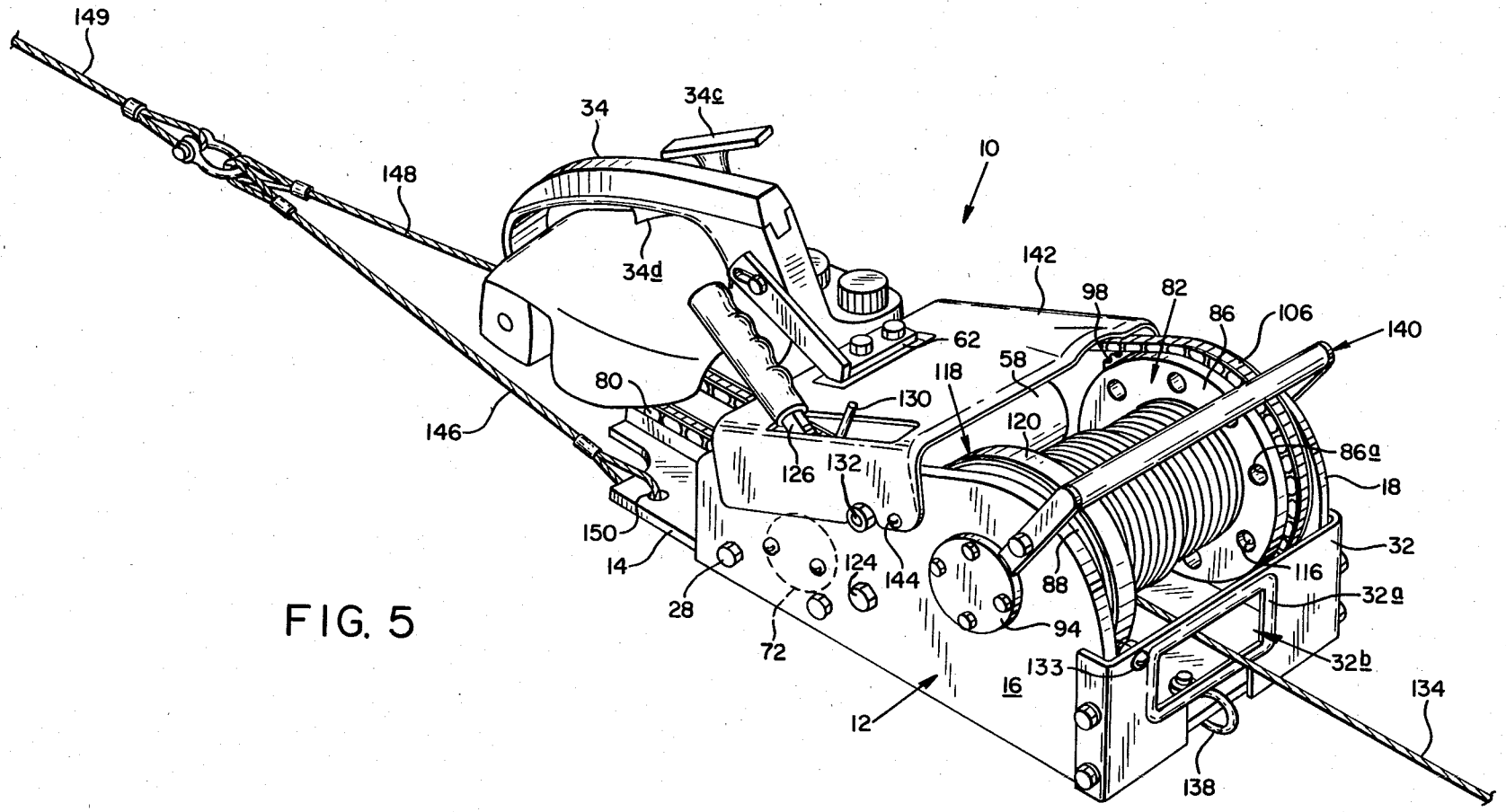
FIG. 5 is a perspective view of the winch in an airborne, operating condition.

Referring now to FIG. 5, cover plate 142 extends forward of engine 34 towards the drum assembly.

Cover plate 142 may be formed of a molded fiberglass material, and formed to extend partially over frame sides 16 and 18. The cover is held in place by brace 62 and by screws which secure the cover plate to the sides, such as that shown at 144. A safety feature of the cover plate is the location of the holes which receive screws such as 144. The holes are located close to the edge of the plate allowing the plate to brake away should a winch operator accidentally place his hand in the area of the drum assembly.

Returning to FIG. 2, the winch may be anchored to a stationary object by means of a pair of anchor cables 146, 148 which are connected to what is referred to herein as anchor attachment means. Anchor attachment means in the preferred embodiment consists of a pair of spaced-apart bores 150, 152 which are positioned in base 14 adjacent motor 34. Bores 150 and 152 are positioned such that they are equidistant from a center line 154 which passes through a center point **84*b* on drum shaft 84. It should be noted that line 154 is a center line with reference to shaft 84 as formed between flanges 86 and 88, and is not necessarily the exact center of base 14. The arrangement of the attachment points and the drum shaft provides for substantially straight-line pull between cable 134 and anchor cables 146 and 148**.

In operation, anchor cables 146 and 148 are initially secured to an anchor point, such as a tree or stationary vehicle, or to a cable secured to an anchor, such as cable 149, shown in FIG. 5. Brake lever 126 is moved to its released position and pin 116 is retracted. Cable 134 may then be paid out from drum and hook 136 attached to an object which is to be drawn towards the winch.

Pin 116 is then rotated by means of end **116*b* to its extended position, and the drum rotated until a bore in flange 86 aligns with pin 116, thereby establishing a driving condition. Engine 34 is started by means of starting handle 34*c*. The speed of the engine is controlled by means of trigger 34*d* connected to the usual throttle. When trigger 34*d* is depressed, shaft 34*a* will rotate, thereby driving the winch and causing cable 134** to be wound onto the drum.

As the cable winds in, several important considerations of the structure of the invention should be noted. First, as previously noted, engine 34 incorporates a clutch assembly in conjunction with shaft **34*a*. The clutch provides that the engine may be running while sprocket 36 is in a "neutral", or declutched condition, thus remaining stationary. As trigger 34*d* is depressed and the engine speeds up, the centrifugal clutch gradually engages, thereby rotating sprocket 36 and causing drive chain 80 to move in the direction indicated by arrow 156. The gradual engagement of the clutch provides a gradually increasing load on transmission 58**, thereby not subjecting the transmission to a sudden shock as would be applied if a clutch were not used.

Second, oil diverter plate 38 acts to divert oil from automatic oiling port **34*b* onto chain 80 as chain 80 moves past the underside of diverter 38. Engines such as that used to power the winch, are capable of producing output shaft speeds on the order of 10,000 RPM. As such, it is desirable that chain 80 and sprockets 36 and 78 be well lubricated. This is accomplished by means of positioning diverter 38 to transfer oil from engine 34 to chain 80**.

A third consideration is the relationship between transmission 58, outrigger bearings 68 and 70, interlocking device 110 and brake 118. As previously stated, transmisson 58 is designed to operate with a maximum 1/10 HP input. Engine 34 is capable of producing up to 2 HP. The additional forces are absorbed by the outrigger bearings, thereby protecting the internal bearings of transmission 58. If it is necessary for the operator to hold an object at a given position with the winch, trigger 34 may be released, thereby alllowing engine 34 to come to an idle speed such that sprocket 36 and shaft **34*a* cease rotation. Obviously, any force exerted on cable 134 will not be sufficient to cause a backup of the assembly, as it would be virtually impossible to turn output sprocket 108 against the internal workings of transmission 58. However, under such a condition the driving components of the winch are placed under strain. This strain may be relieved by locking brake 118 thereby transferring any forces which have been applied to the driving components to the brake. Once braking lever 126 has been locked into its braking position, and the drum secured, engine 34 may be shut off. By manually moving chain 80 in a direction opposite that shown by arrow 156, tension between sprockets 108 and 98 may be decreased, and, if desired, pin 116** may be retracted.

When the winch is configured as previously described, it is possible to pay out or continue taking up cable, depending on the needs of the situation. Cable may be payed out by manually applying pressure on lever 126 and releasing pawl 130. Lever 126 may be slightly moved towards its released position, thereby lessening the friction exerted by brake lining **120*b* on flange 88, and allowing the drum assembly to rotate, at a desired speed, allowing cable 134** to be paid out as desired.

Should the operator desire to take in cable, the drive sprocket and drum assembly may be engaged, by manipulating chain 80, thereby manually positioning pin 116 opposite a bore in flange 86, or, engine 34 may be started with pin 116 in a retracted position and the pin subsequently moved to an extended position, and allowed to index with a bore in flange 86, thereby establishing a driving condition. Once pin 116 has established a driving condition, the brake may be released, the engine revved up, and the cable further taken in.

It is desirable that the cable be wound on the drum in an even manner. As previously noted, when a load is applied to the winch, the winch tends to become airborne, suspended between cable 134 and the anchor cables, as depicted in FIG. 5. As the cable is taken up, the operator may manipulate the winch in a rolling motion, generally about line 154, by means of handle 140. The drum assembly rotates in the direction indicated by arrow 158 during cable take in. Cable tends to wind "up-hill". It can be appreciated that as the winch is rocked to a position with side 18 relatively higher than side 16, that the cable will spool onto the drum towards side 18. As cable winds close to flange 86, the winch may be tilted such that side 16 becomes relatively higher than side 18, thereby causing the cable to spool on the drum towards side 16. Handle 140 thus acts as a combination handle and fairlead to promote even winding of the cable on the drum assembly. Were the cable not wound evenly on the drum assembly, the cable would be unnecessarily stressed, resulting in frayed cable strands and ultimately, in a weakened cable.

Cable guide opening **32*b* is laterally narrower than the region between the drum flanges. This prevents the cable from rubbing on the flanges, thereby damaging the flanges. Winding the cable evenly on the center of the drum prevents excessive forces from being exerted on the bearings on one side of the drum assembly, as the forces are generally evenly distributed between bearings 90 and 92**.

If it is desirable to achieve an even greater mechanical advantage than that provided by the winch as thus described, cable 134 may be run out to an object to be moved and hook 136 returned to the winch and attached at clevis 138, thereby doubling the already considerable mechanical advantage of the winch.

Engine 34 may be operated at any speed which the engine is capable of attaining, generally something from several hundred to 10,000 RPM. The clutch assembly of the engine will generally activate at a low RPM. As previously stated, the winch has an overall ratio of 222:1, therefore, when engine 34 is turning at top speed of 10,000 RPM, drive sprocket 98 will turn at 45 RPM. In the preferred embodiment, the drum flanges are 6 inches in diameter and the drum shaft is 1½ inches in diameter along the region located between the flanges. For a nominal cable diameter, as spooled on the drum, of 2½ inches, the winch is capable of drawing in cable at a speed of approximately 30 feet per minute at maximum engine RPM. The speed may, of course, be adjusted downward by utilizing lower engine RPM.

It will be obvious to those skilled in the art that other types of motors may be utilized as motor means in a portable winch. Were a motor utilized, such as an electric, or hydraulic motor, which were capable of operating reversibly, the winch would achieve the ability to both take-in and pay-out cable under power. Additionally, it can be appreciated that a shorter length of a heavier cable may be wound on the drum to provide even greater lifting or pulling capability.

The portable winch, as described and constructed according to the preferred embodiment, weighs 38 lbs. with a full gas tank and a full oil tank.

Although a preferred embodiment of the instant invention has been described, it should be appreciated that variations and modifications may be made without departing from the spirit of the invention.

It is claimed and desired to secure as Letters Patent:

1. A portable winch comprising a chain saw motor unit including a gasoline-powered engine, a housing for the engine, a motor output shaft with clutch driven by the engine, said output shaft extending laterally of the chain saw motor unit, an elongate frame including an elongate base and opposed upstanding sides extending upwardly from opposed side margins of said base joined to said base, means securing said housing of the chain saw motor unit to the base of said frame adjacent one end of said frame with the chain saw motor unit disposed above said base and with an end of the motor unit facing toward the opposite end of said frame and with said motor output shaft above and extending transversely of said frame base, a winch drum assembly including a winch drum and drum shaft means extending axially of the drum and having ends projecting from opposite ends of the drum, said winch drum assembly being located between said frame sides and above said base adjacent said opposite end of said frame, bearings journaling said ends of said drum shaft on said frame sides, a speed-reducing transmission including input and output shafts which extend out from opposite sides of the transmission, said transmission being secured to said frame with the transmisssion positioned intermediate the chain saw motor unit and said drum assembly and between said frame sides with said ends extending inwardly therefrom, bearings journaling said input and outputs shafts on said sides of the frame, first power-transmitting means extending longitudinally of said frame inwardly of the frame sides connecting the clutch of the motor output shaft and the input shaft of the speed-reducing transmission, and second power-transmitting means extending longitudinally of said frame with said input and output shafts extending inwardly therefrom inwardly of the frame sides connecting the output shaft of said speed-reducing transmission and said drum shaft.

2. The portable winch of claim 1, wherein said frame sides extend upwardly from said bearings journaling the drum shaft and speed reducing transmission shafts to be in a covering relation over the sides of said speed-reducing transmission and the ends of the drum.

3. The portable winch of claim 2, which further includes a cover plate secured to said frame extending over said speed-reducing transmission and over portions of said frame sides disposed on either side of said speed-reducing transmission.

4. The portable winch of claim 1, wherein said drum has opposed end flanges at opposite ends thereof and which further includes a brake tightenable over one end flange to brake movement of the drum, and wherein said second power-transmitting means connects said speed-reducing transmission output shaft with said drum shaft through the other of said end flanges and which further includes selection means for selectively drivingly connecting and disconnecting the second power-transmitting means and drum shaft.

5. The portable winch of claim 4, wherein said second power-transmitting means includes a drive sprocket having said selection means mounted thereon and said other end flange includes at least one bore therein, said selection means having a spring-biased pin, receivable in said bore for releasably locking said drive sprocket to said other end flange, said pin being retractable to disestablish a driving connection, and being extensible to establish a driving connection.

6. The portable winch of claim 1, wherein said frame includes a pair of spaced-apart anchor-attachment means adjacent said one end for securing said frame to an anchor, and said drum shaft means includes a center point intermediate said flanges, said anchor attachment means being positioned to form the base of an isosceles triangle with said center point, said anchor-attachment means being located intermediate said opposed upstanding sides.

* * * * *